US006802235B2

(12) United States Patent
Junkers et al.

(10) Patent No.: US 6,802,235 B2
(45) Date of Patent: Oct. 12, 2004

(54) FLUID-OPERATED TORQUE WRENCH

(75) Inventors: John K. Junkers, Saddle River, NJ (US); Peter Koppenhoefer, Portland, PA (US)

(73) Assignee: Unex Corporation, Mahwah, NJ (US)

( * ) Notice: Subject to any disclaimer, the term of this patent is extended or adjusted under 35 U.S.C. 154(b) by 0 days.

(21) Appl. No.: 10/037,991

(22) Filed: Jan. 4, 2002

(65) Prior Publication Data

US 2003/0126956 A1 Jul. 10, 2003

(51) Int. Cl.[7] ..... B25B 13/46
(52) U.S. Cl. ..... 81/57.39; 81/57.44
(58) Field of Search ..... 81/57.39, 57.44, 81/60, 61

(56) References Cited

U.S. PATENT DOCUMENTS 4,201,099 A 5/1980 Junkers
4,233,865 A * 11/1980 Junkers ..... 81/57.39
4,409,865 A 10/1983 Krautter et al.
4,706,527 A 11/1987 Junkers
5,005,447 A 4/1991 Junkers
5,611,489 A * 3/1997 Berneuil et al. ..... 92/65
5,953,967 A 9/1999 Reiman et al.

FOREIGN PATENT DOCUMENTS

EP 0 324 050 A 7/1989

* cited by examiner

*Primary Examiner*—Debra S. Meislin

(57) ABSTRACT

A fluid operated torque wrench has a housing having a cylinder portion with a cylinder having an axis and a driving portion; two pistons movable in the cylinder along the axis independently from one another and having piston rods; two ratchet-lever mechanisms located in the driving portion; a drive element to which both the ratchet-lever mechanisms are connected; a fluid supply into the cylinder, the pistons being formed so that when the fluid is supplied at opposite sides of the pistons, either one ratchet-lever mechanism turns and the other ratchets, or vice versa.

1 Claim, 2 Drawing Sheets

FLUID-OPERATED TORQUE WRENCH

BACKGROUND OF THE INVENTION

The present invention relates to fluid operated torque wrenches.

Fluid operated torque wrenches are known and widely utilized. Especially advantageous are fluid operated torque wrenches which provide continuous rotation of its drive element connected to a threaded fastener, such as a bolt, a nut, and the like and provide continuous turning and tightening of these fastening elements. It is believed that the existing fluid-operated torque wrenches of the above mentioned general type can be further improved.

SUMMARY OF THE INVENTION

Accordingly, it is an object of the present invention to provide a fluid operated torque wrench for a continuous rotation, which is a further improvement of the existing torque wrenches of this type.

In keeping with these objects and with others which will become apparent hereinafter, one feature of present invention resides, briefly stated, in a fluid operated torque wrench which has a housing having a cylinder portion with a cylinder having an axis and a driving portion; two pistons movable in said cylinder along said axis independently from one another and having piston rods; two ratchet-lever mechanisms located in said driving portion; a drive element to which both said ratchet-lever mechanisms are connected; means for supplying a fluid into said cylinder, said pistons being formed so that when the fluid is supplied by said fluid supplying means at one side of one of said pistons and at another opposite side of the other of said pistons as considered as in axial direction, said one piston moves in one axial direction allowing one of said ratchet-lever mechanisms to ratchet while said other piston moves in an opposite axial direction to turn the other ratchet-lever mechanism so as to turn said drive element, while when the fluid is supplied at the other side of said one piston and simultaneously at one side of said other piston as considered in the axial direction said one piston moves in said other axial direction to turn said one ratchet-lever mechanism to turn said drive element while said other piston moves in said one axial direction allowing said one ratchet-lever mechanism to ratchet.

When the fluid-operated torque wrench is designed in accordance with the present invention, it is a further improvement of the fluid-operated wrenches for continuous rotation of a threaded fastener.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
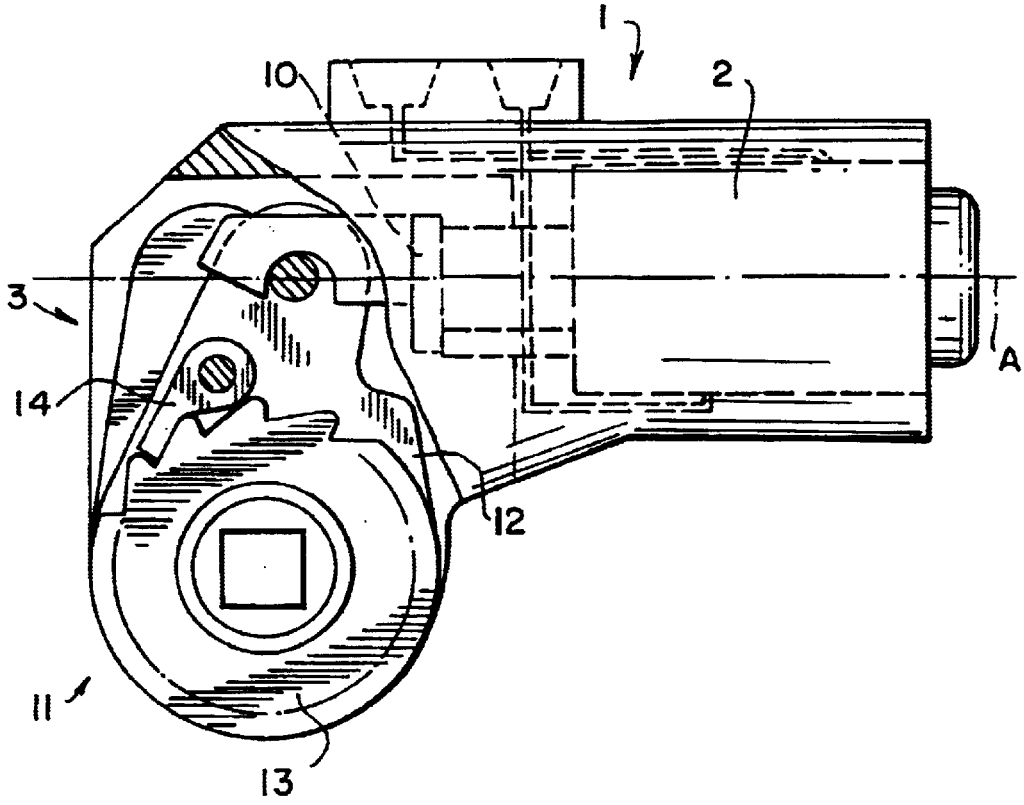
FIG. 1 is a front view of a fluid operated torque wrench in accordance with the present invention.

A fluid operated torque wrench in accordance with the present invention has a housing which is identified as a whole with reference numeral 1 and has a first housing portion 2 which is formed as a cylinder portion, and a second housing portion 3 which is formed as a driving portion. The cylinder portion 2 which forms a cylinder 4 has an axis which is identified as A. Two pistons are accommodated in the cylinder 4 of the cylinder portion 2 and are reciprocatingly movable in direction of the axis A independently from one another. One piston which is identified with reference numeral 5 and has a hollow piston rod 6 with a rod end 7 connected to it. The other piston 8 has a solid piston rod 9 extending through the hollow piston 5 and having a second rod end 10 connected therewith.

The fluid operated torque wrench further has two ratchet-lever mechanisms which are known per se and each include drive plates, a ratchet located between the drive plates, a pawl arranged on the drive plates and engageable with the ratchet. FIG. 1 shows one of the ratchet lever mechanisms 11 which has drive plates 12 (only one shown), a ratchet 13 turnably arranged between said drive plates, and a pawl 14 turnably mounted on one of the drive plates 12 and engageable with the ratchet 13. The ratchet lever mechanism 11 is connected with the rod end 10 of the rod 9 of the piston 8. The other ratchet lever mechanism 15 is connected with the rod end 7 of the piston rod 6 of the piston 5.

Finally, the fluid operated torque wrench has means for supplying a power fluid from a not shown source of the power fluid. The fluid supplying means includes a first fluid supplying system 16 and a second fluid supplying system 17 shown in FIG. 2. The first fluid supplying system 16 includes fluid supplying channels formed to supply the fluid at one side of the piston 5 and at an opposite, other side of the piston 8 as considered in an axial direction, while the second fluid supplying system 17 includes fluid supplying channels for supplying the fluid at the opposite side of the piston 5 and at the one side of the piston 8.

The fluid operated wrench further has a drive element which is identified with reference numeral 18. The drive element 18 is common for both ratchet lever mechanisms 11 and 15 and connected with the ratchets of the both mechanisms so as to be turned when the ratchet of any of the ratchet lever mechanisms 11, 15 is turned.

The fluid-operated torque wrench operates in the following manner.

Figure 2:
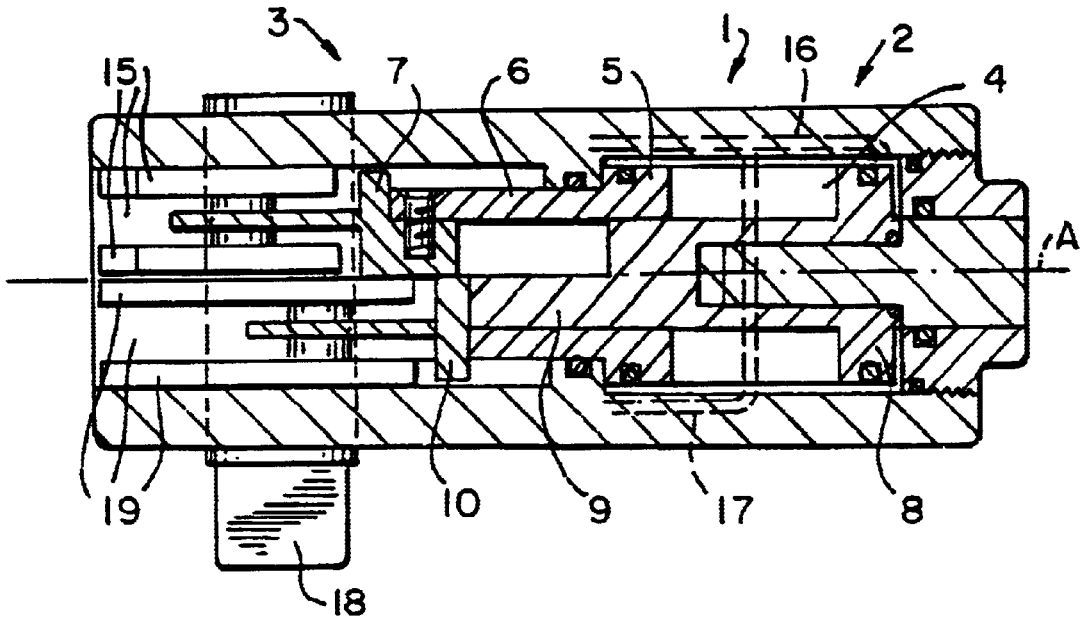
FIG. 2 is a top view of the inventive fluid operated torque wrench, in a cross-section.

When the fluid is supplied through the fluid supply system 16, the fluid acts on the piston 5 from one side or the left side in FIG. 2 and also acts on the piston 8 from the other opposite side or the right side, the piston 5 moves to the right allowing the ratchet lever mechanism 15 to ratchet, while the piston 8 is moved to the left to turn the ratchet-lever mechanism 11 so as to turn the drive element 18. When thereafter the fluid is supplied through the fluid system 17 so as to act on the piston 5 from the opposite side or the right side and to act on the piston 8 from the one side or the left side, then the piston 5 is moved to the left and the piston 8 is moved to the right, so that the ratchet-lever mechanism 15 turns the drive element 18, while the ratchet-lever mechanism 11 is allowed to ratchet. Thus, a continuous turning of the drive element 18 is provided.

The housing has a rod 20 which extends to the left and has the same diameter as the piston rod 9 of the piston 8, to assure that both pistons 5 and 8 have the same piston areas 21 and 22 correspondingly at the right side.

It will be understood that each of the elements described above, or two or more together, may also find a useful application in other types of constructions differing from the types described above.

While the invention has been illustrated and described as embodied in a fluid-operated torque wrench, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A fluid operated torque wrench, comprising a housing having a cylinder portion with a cylinder having an axis, said housing also having a driving portion; two pistons movable in said cylinder along said axis independently from one another and each having a piston rod; two ratchet-lever mechanisms located in said driving portion; said piston rods of said pistons being connected with said ratchet-lever mechanisms; a drive element to which both said ratchet-lever-mechanisms are connected; means for supplying a fluid into said cylinder, said pistons being formed so that when the fluid is supplied by said fluid supplying means at one side of one of said pistons and at another opposite side of the other of said pistons as considered in an axial direction, said one piston moves in said cylinder in one axial direction allowing one of said ratchet-lever mechanisms to ratchet while said other piston moves also in said cylinder in an opposite axial direction to turn the other ratchet-lever mechanism so as to turn said drive element, while when the fluid is supplied at the other side of said one piston and simultaneously at one side of said other piston as considered in the axial direction said one piston moves also in said cylinder in said other axial direction to turn said one ratchet-lever mechanism to turn said drive element while said other piston moves also in said cylinder in said other axial direction allowing said other ratchet lever-mechanism to ratchet, one of said pistons being hollow and having a hollow piston rod to which a first rod end is connected, while the other of said pistons has a solid piston rod extending into said hollow piston rod and having an opposite side, said rod ends being connected to corresponding ones of said ratchet-lever mechanisms, said other piston having a rod extending from said other piston and having a same diameter as said solid piston rod to assure that said pistons have the same piston areas, said rod of said other piston being movable together with said other piston and slidable within a rear portion of said housing.

* * * * *